US008960664B2

(12) United States Patent
Maeda et al.

(10) Patent No.: US 8,960,664 B2
(45) Date of Patent: Feb. 24, 2015

(54) IMAGE FORMING APPARATUS

(71) Applicant: Canon Kabushiki Kaisha, Tokyo (JP)

(72) Inventors: Masanori Maeda, Yokohama (JP); Daisuke Aoki, Yokohama (JP); Yu Shuhama, Yokohama (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/764,924

(22) Filed: Feb. 12, 2013

(65) Prior Publication Data

US 2013/0228967 A1 Sep. 5, 2013

(30) Foreign Application Priority Data

Mar. 1, 2012 (JP) ..... 2012-045801

(51) Int. Cl.
*B65H 1/00* (2006.01)
*B65H 1/26* (2006.01)

(52) U.S. Cl.
CPC ..... *B65H 1/00* (2013.01); *B65H 1/266* (2013.01); *B65H 2402/32* (2013.01); *B65H 2405/121* (2013.01); *B65H 2801/12* (2013.01)
USPC ..... 271/162; 399/110

(58) Field of Classification Search
None
See application file for complete search history.

(56) References Cited

U.S. PATENT DOCUMENTS

| | | | | |
|---|---|---|---|---|
| 3,684,363 | A | 8/1972 | Ito et al. | |
| 3,784,297 | A | 1/1974 | Ito et al. | |
| 4,000,942 | A | 1/1977 | Ito et al. | |
| 4,050,691 | A | 9/1977 | Ito et al. | |
| 4,953,037 | A | 8/1990 | Ito et al. | |
| 5,562,280 | A | 10/1996 | Niimura et al. | |
| 6,994,341 | B2 | 2/2006 | Aoki et al. | |
| 7,769,319 | B2 * | 8/2010 | Sato | 399/110 |
| 8,523,466 | B2 | 9/2013 | Mizuguchi et al. | |
| 2006/0067732 | A1 * | 3/2006 | Igarashi | 399/110 |
| 2006/0140669 | A1 * | 6/2006 | Sato | 399/110 |
| 2011/0206441 | A1 | 8/2011 | Mizuguchi et al. | |
| 2011/0311269 | A1 * | 12/2011 | Murooka | 399/110 |

FOREIGN PATENT DOCUMENTS

| | | | |
|---|---|---|---|
| JP | 2006-069732 | A | 3/2006 |
| JP | 2006193300 | A | 7/2006 |
| JP | 2011175108 | A | 9/2011 |
| JP | 5103492 | B2 | 10/2012 |

* cited by examiner

*Primary Examiner* — Thomas Morrison
(74) *Attorney, Agent, or Firm* — Fitzpatrick, Cella, Harper & Scinto

(57) ABSTRACT

An image forming apparatus capable of easily performing jammed sheet recovery in a sheet feeding portion is provided. Upper guide grooves that guide attachment and detachment of a conveyance guide member and lower guide grooves that guide attachment and detachment of a sheet feeding cassette are formed in supporting plates that are provided in attachment and detachment directions in an apparatus body to face each other. When jamming occurs, a space near the sheet feeding portion is secured by extracting the conveyance guide member from the apparatus body.

13 Claims, 10 Drawing Sheets

IMAGE FORMING APPARATUS

BACKGROUND OF THE INVENTION

1. Field of the Invention

The present invention relates to an image forming apparatus, and more particularly, to an image forming apparatus in which a sheet conveyance path along which a sheet passes is formed above a sheet accommodation portion mounted on an apparatus body.

2. Description of the Related Art

In the related art, examples of an image forming apparatus include a copy machine, a laser beam printer, an LED printer, a facsimile apparatus, and a word processor of an electrophotographic image forming system. In such an image forming apparatus according to the related art, generally, frequently used regular sheets are stacked and fed in a sheet feeding cassette in which a predetermined number of sheets can be stacked, and less frequently used regular sheets such as thick sheets or special sheets such as long sheets other than regular sheets are manually fed. Note that the phrase "sheet manually fed" means that a sheet loaded on an image forming apparatus is fed manually by a user.

When a special sheet is fed, a user manually inserts a sheet directly to a conveyance path to feed the sheet to an image forming portion. Here, in such an image forming apparatus, a feeding guide portion which guides the sheet inserted into the conveyance path to the image forming portion is installed above a sheet feeding cassette.

Some image forming apparatuses according to the related art include a re-feeding conveyance portion that feeds a sheet again to an image forming portion to form an image on the rear surface of the sheet after an image is formed on one surface of the sheet. In the re-feeding conveyance portion of the image forming apparatus, a feeding guide portion that guides a sheet in which an image is formed on one surface to the image forming portion is also installed above a sheet feeding cassette.

In the image forming apparatus according to the related art in which the feeding guide portion is installed above the sheet feeding cassette, for example, when jamming occurs in the feeding guide portion, the sheet feeding cassette is extracted from the apparatus body and then the jammed sheet is taken out. However, when the jammed sheet may not be taken out merely by extracting the sheet feeding cassette, jam recovery is performed by rotating the feeding guide portion to open the conveyance path.

As a configuration in which the feeding guide portion is rotated to a position at which jam recovery can be performed, a configuration is suggested in which one end of the feeding guide portion is pivotally supported on an image forming apparatus body and the other end of the feeding guide portion is vertically rotatable (see Japanese Patent Laid-Open No. 2006-69732). When the jammed sheet is taken out, access is possible between the image forming apparatus body and the conveyance path by rotating the feeding guide portion downward, and thus usability of the jam recovery occurring in a sheet feeding portion can be improved.

In the image forming apparatus according to the related art, however, when the feeding guide portion is rotated downward, a work space is narrowed due to the fact that the rotation amount is small near the pivot portion of the feeding guide portion, and thus it is difficult to perform the jammed sheet recovery. In particular, with recent miniaturization of an apparatus, a space of a mounted portion of a sheet feeding cassette in a height direction is narrowed and, accordingly, it is difficult to stretch a hand into the space. Therefore, it is more difficult to perform the jammed sheet recovery.

The present invention is devised in view of such a circumstance and it is desirable to provide an image forming apparatus capable of easily performing jammed sheet recovery in a sheet feeding portion.

SUMMARY OF THE INVENTION

According to an aspect of the invention, an image forming apparatus includes: a sheet accommodation portion that is detachably mounted on an apparatus body; a conveyance guide member that is detachably mounted on the apparatus body above the sheet accommodation portion mounted on the apparatus body, and forms a sheet conveyance path which guides a sheet; and supporting portions that are installed in the apparatus body to face each other and laterally support the sheet accommodation portion and the conveyance guide member, and that include first guide portions guiding attachment and detachment of the sheet accommodation portion into and from the apparatus body and second guide portions guiding attachment and detachment of the conveyance guide member into and from the apparatus body.

According to the aspect of the invention, the second guide portions formed in the supporting portions guide the attachment and detachment of the conveyance guide member. When jamming occurs, jammed sheet recovery can easily be performed in the sheet conveyance path by extracting the conveyance guide member from the apparatus body.

Further features of the present invention will become apparent from the following description of exemplary embodiments with reference to the attached drawings.

DESCRIPTION OF THE EMBODIMENTS

Figure 1:
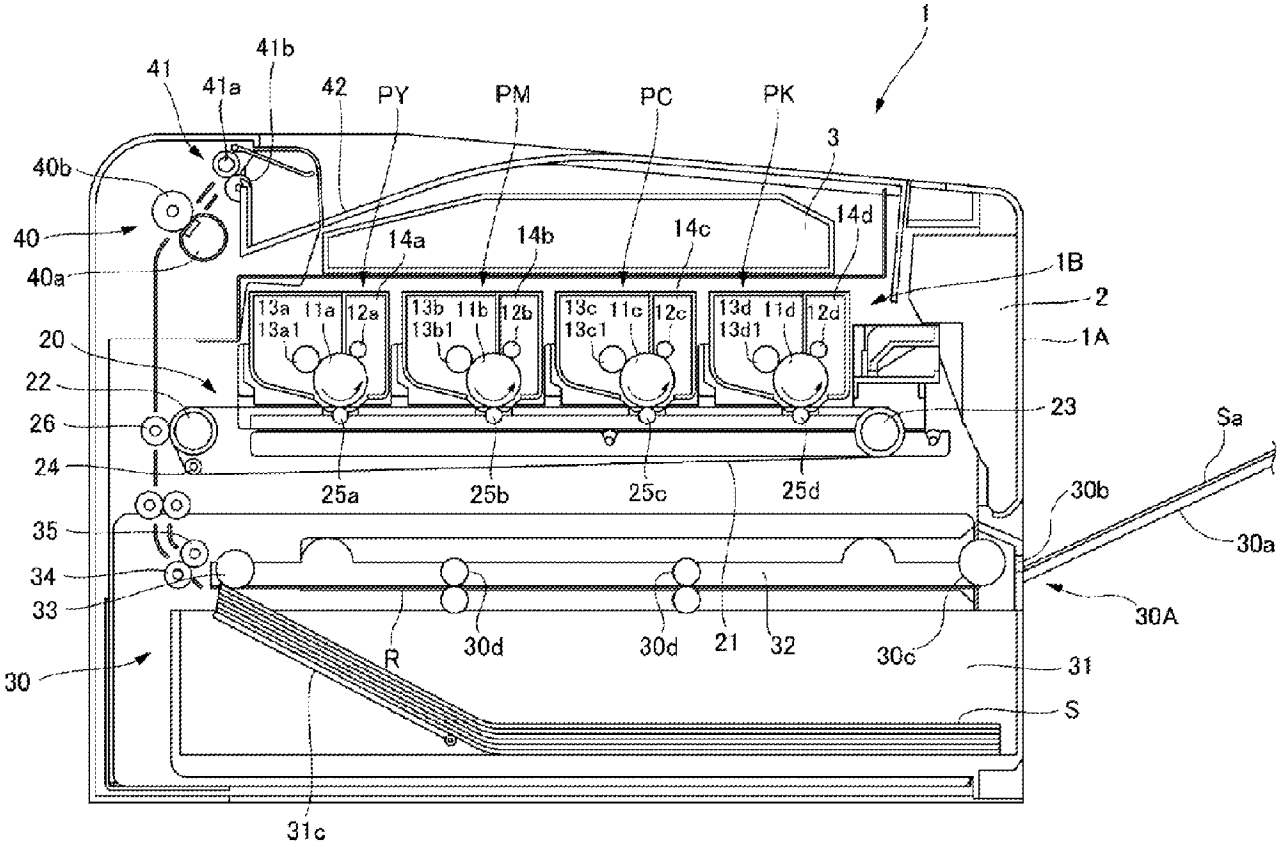
FIG. 1 is a diagram illustrating the overall configuration of a color laser beam printer which is an example of an image forming apparatus according to a first embodiment of the present invention.

Hereinafter, embodiments of the present invention will be described in detail with reference to the drawings. FIG. 1 is a diagram illustrating the overall configuration of a color laser beam printer which is an example of an image forming apparatus according to the first embodiment of the invention. In FIG. 1, a color laser beam printer 1 and a color laser beam printer body (hereinafter, referred to as a printer body) 1A are illustrated. The color laser beam printer 1 includes an image forming portion 1B which forms an image and a sheet feeding portion 30.

The image forming portion 1B includes process cartridges P (PY, PM, PC, and PK) which are four image forming units corresponding to four colors of magenta (M), yellow (Y), cyan (C), and black (Bk) installed in parallel. The image forming portion 1B includes a laser scanner unit 3 located above the process cartridges P and an intermediate transfer belt unit 20 including an intermediate transfer belt 21.

Here, the process cartridges P include photosensitive drums 11 (11*a* to 11*d*) disposed to be rotatable counterclockwise, respectively. An electrostatic latent image is formed on the surface of the photosensitive drum 11 through exposure of the laser scanner unit 3. Further, the process cartridges P include chargers 12 (12*a* to 12*d*) and development rollers 13*a*1 to 13*d*1, respectively. The process cartridges P also include development devices 13 (13*a* to 13*d*) that accommodate developer (toner) inside a developer container and cleaning devices 14 (14*a* to 14*d*), respectively.

The intermediate transfer belt unit 20 includes an endless intermediate transfer belt 21 that has a flexible property as a dielectric property, a driving roller 22 that stretches and cyclically moves the intermediate transfer belt 21, a turn roller 23, and a tension roller 24. Primary transfer rollers 25 (25*a* to 25*d*) facing the photosensitive drums 11, respectively, are installed inside the intermediate transfer belt 21. A secondary transfer roller 26 abuts on the driving roller 22 with the intermediate transfer belt 21 interposed therebetween.

The sheet feeding portion 30 includes a sheet feeding cassette 31 which is a sheet accommodation portion detachably mounted on a printer body 1A which is the image forming apparatus body, and a sheet feeding roller 33 that feeds a sheet S accommodated in the sheet feeding cassette 31. The sheet feeding cassette 31 includes a sheet supporting plate 31*c* that supports the sheet S and presses the accommodated sheet S against the sheet feeding roller 33.

In FIG. 1, an apparatus opening and closing door 2 are illustrated. In this embodiment, the side on which the apparatus opening and closing door 2 is installed is the front side (front surface side) of the color laser beam printer 1. A conveying roller 35 and a separation roller 34 that forms a separation portion and presses the conveying roller 35 to separate a sheet are also illustrated. A conveyance guide member 32 forms a sheet conveyance path R along which a sheet is guided from a manual sheet feeding portion 30A installed on one side of the printer body 1A to the separation portion when the sheet is manually fed. In this embodiment, the conveyance guide member 32 is installed to be freely detachably mounted from the front side of the printer body 1A.

Next, an image forming operation performed by the color laser beam printer 1 having the above-described configuration will be described. To form a color image on a sheet, first, the photosensitive drum 11 of each process cartridge P is rotatably driven counterclockwise at a predetermined control speed. Further, the intermediate transfer belt 21 is also rotatably driven in a direction following the drum rotation at a speed corresponding to the speed of the photosensitive drum 11, and the laser scanner unit 3 is also driven at the substantially identical timing. In each process cartridge P, the charger 12 uniformly charges the surface of the photosensitive drum 11 with a predetermined polarity/potential at predetermined control timing in synchronization with the driving. Thereafter, the laser scanner unit 3 performs exposure on the photosensitive drums 11 based on an image signal of each color component transmitted from a controller (not illustrated). Thus, an electrostatic latent image is formed on the surface of each photosensitive drum.

Next, in each process cartridge P, the electrostatic latent image is developed by each color toner of magenta, yellow, cyan, and black and a toner image is formed on each photosensitive drum. Thereafter, when the toner image reaches a transfer region in which each photosensitive drum 11 and the intermediate transfer belt 21 abut with each other with the rotation of each photosensitive drum 11, a primary transfer bias is applied by the primary transfer roller 25. Thus, the toner images on the photosensitive drums are sequentially transferred onto the intermediate transfer belt in the order of magenta, yellow, cyan, and black with the rotation of the intermediate transfer belt 21, and consequently, a color toner image is formed on the intermediate transfer belt.

On the other hand, the sheet S is fed from the sheet feeding cassette 31 by the sheet feeding roller 33 at predetermined sequence control timing in parallel with the operation of forming the color toner image. The sheet S is separated by the separation roller 34 and the conveying roller 35 one by one and is conveyed to a secondary transfer portion including the driving roller 22 and the secondary transfer roller 26. Then, the secondary transfer portion collectively transfers the color toner image on the sheet by a transfer bias applied to the secondary transfer roller 26.

Next, the sheet S to which the color toner image has been transferred is separated from the intermediate transfer belt 21 and is introduced to a fixing device 40 including a fixing film assembly 40*a* and a pressure roller 40*b*. When the sheet S passes through the fixing device 40, the sheet S is heated and pressed in a fixing nip portion so that a mixture of colors of the color toner images is produced and fixed. Thereafter, the sheet S on which the color toner image is fixed is discharged to a discharge tray 42 installed on the upper surface of the printer body by a pair of discharge rollers 41 including a discharge roller 41*a* and a discharge roller 41*b*.

When a user manually feeds a sheet, a user sets a manual sheet Sa on a manual tray 30*a* of the manual sheet feeding portion 30A installed on one side of the printer body 1A. The manual sheet feeding portion 30A includes the manual tray 30*a* and a manual sheet feeding roller 30*c* that feeds the manual sheet Sa placed on the manual tray 30*a*.

The sheet Sa set in the manual tray 30*a* is fed from a manual feed port 30*b* to the sheet conveyance path R by the manual sheet feeding roller 30*c*, is conveyed by a pair of conveying rollers 30*d* disposed in the sheet conveyance path R, and then reaches the separation portion. After the sheet Sa reaches the separation portion, a color toner image is transferred and fixed on the sheet Sa and the sheet Sa is discharged to the discharge tray 42, as in the sheet S stacked in the sheet feeding cassette 31.

Figure 2A:
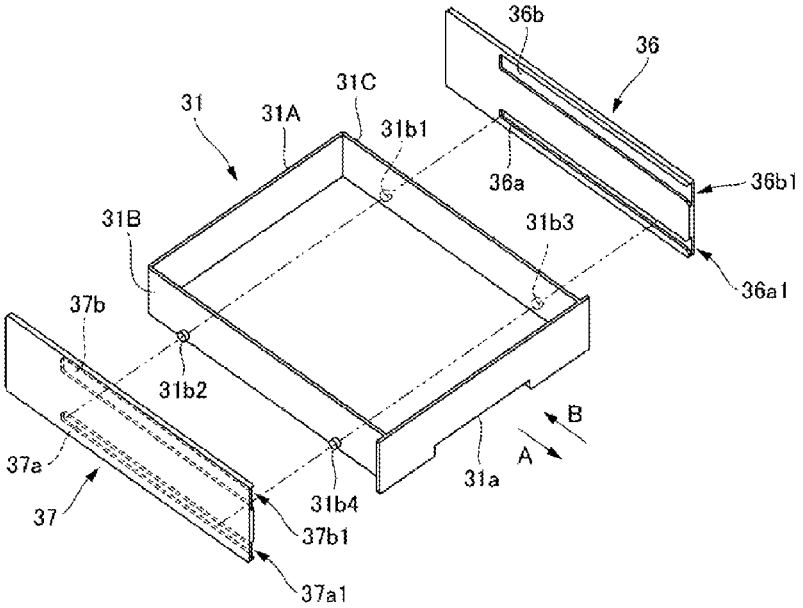
FIGS. 2A and 2B are diagrams illustrating the configuration of a guide portion, a sheet feeding cassette, and a conveyance guide member installed in the color laser beam printer.
Figure 2B:
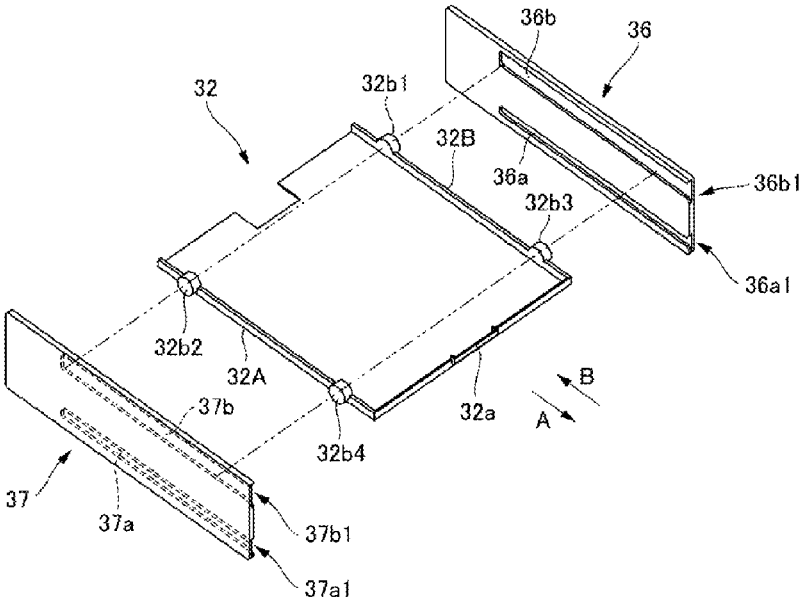

In this embodiment, as illustrated in FIGS. 2A and 2B, two supporting plates 36 and 37 which are supporting portions supporting the sheet feeding cassette 31 and the conveyance guide member 32 from the sides are disposed to face each other in the detachment and attachment directions of the sheet feeding cassette 31 in the lower portion of the printer body 1A. Here, as illustrated in FIG. 2A, two protrusion portions 31*b*1 to 31*b*4 respectively protrude from two side walls (both sides) 31B and 31C parallel to the attachment and detachment directions of a cassette body 31A of the sheet feeding cassette 31 that accommodates the sheets. The protrusion portions 31*b*2 and 31*b*4 of one side wall 31B are formed to be symmetric to the protrusion portions 31*b*1 and 31*b*3 of the other side wall 31C, respectively. Further, a handle 31*a* to be operated by the user to extract the sheet feeding cassette 31 is formed on the front side of the cassette body 31A.

As illustrated in FIG. 2B, two protrusion portions 32*b*1 to 32*b*4 respectively protrude from both ends 32A and 32B parallel to the attachment and detachment directions of the conveyance guide member 32. The protrusion portions 32*b*2 and 32*b*4 in one end of the conveyance guide member 32 are formed to be symmetric to the protrusion portions 32*b*1 and 32*b*3 in the other end of the conveyance guide member 32, respectively. Further, a handle 32*a* to be operated by the user to extract the conveyance guide member 32 is formed on the front side of the conveyance guide member 32.

Figure 3:
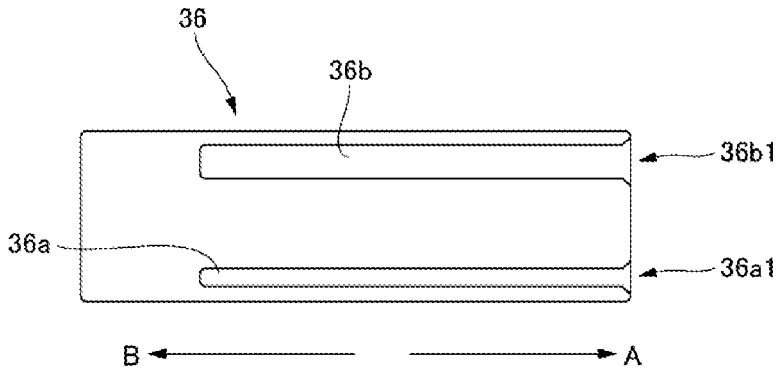
FIG. 3 is a side view illustrating the guide portion.

On the other hand, as illustrated in FIG. 3, a lower guide groove 36*a* which extends in the attachment and detachment directions and which the protrusion portions 31*b*1 and 31*b*3 of the side wall 31C of the sheet feeding cassette 31 are inserted into at the time of mounting the sheet feeding cassette 31 is formed in the lower portion of one supporting plate 36 between the two supporting plates 36 and 37. Further, an opening portion 36*a*1 which the protrusion portions 31*b*1 and 31*b*3 are inserted into and extracted from is formed at the upstream-side end of the lower guide groove 36*a* in a mounting direction.

As illustrated in FIGS. 2A and 2B, a lower guide groove 37*a*, which extends in the attachment and detachment directions and which the protrusion portions 31*b*2 and 31*b*4 of the side wall 31B of the sheet feeding cassette 31 are inserted into at the time of mounting the sheet feeding cassette 31, is formed in the lower portion of the other supporting plate 37. Further, an opening portion 37*a*1 which the protrusion portions 31*b*2 and 31*b*4 are inserted into and extracted from is formed at the upstream-side end of the lower guide groove 37*a* in the mounting direction. The lower guide groove 37*a* is formed to be symmetric to the lower guide groove 36*a* of the one supporting plate 36.

As illustrated in FIG. 3, an upper guide groove 36*b*, which extends in the attachment and detachment directions and which the protrusion portions 32*b*1 and 32*b*3 at one end of the conveyance guide member 32 are inserted into at the time of mounting the conveyance guide member 32, is formed in the upper portion of the one supporting plate 36. Further, an opening portion 36*b*1 into which the protrusion portions 32*b*1 and 32*b*3 are inserted is formed at the upstream-side end of the upper guide groove 36*b* in the mounting direction. As illustrated in FIGS. 2A and 2B, an upper guide groove 37*b* which extends in the attachment and detachment directions and which the protrusion portions 32*b*2 and 32*b*4 at the other end of the conveyance guide member 32 are inserted into at the time of mounting the conveyance guide member 32 is formed in the upper portion of the other supporting plate 37. Further, an opening portion 37*b*1 into which the protrusion portions 32*b*2 and 32*b*4 are inserted is formed at the upstream-side end of the upper guide groove 37*b* in the mounting direction. The upper guide groove 37*b* is formed to be symmetric to the upper guide groove 36*b* of the one supporting plate 36.

Here, when a sheet is jammed in the sheet feeding portion 30 in the color laser beam printer 1 with the above-described configuration, the user first holds the handle 31*a* of the sheet feeding cassette 31 illustrated in FIG. 2A and extracts the sheet feeding cassette 31 in a direction indicated by an arrow A. Thus, the sheet feeding cassette 31 is guided to the front side of the printer body 1A, while the protrusion portions 31*b*1 to 31*b*4 are moved along the lower guide grooves 36*a* and 37*a* which are formed in the lower portions of the supporting plates 36 and 37 and are first guide portions guiding the attachment and detachment of the sheet feeding cassette 31.

The jammed sheet recovery is performed by extracting the sheet feeding cassette 31. However, even when the sheet feeding cassette 31 is extracted, an access to the sheet jammed and stopped inside the sheet feeding portion 30 may not be possible. In this case, the user extracts the conveyance guide member 32 in the direction indicated by the arrow A. In this case, the user first holds the handle 32*a* formed in the conveyance guide member 32 illustrated in FIG. 2B and extracts the conveyance guide member 32 to the front side of the printer body 1A. Thus, the conveyance guide member 32 is guided to the front side of the printer body 1A, while the protrusion portions 32*b*1 to 32*b*4 are moved along the upper guide grooves 36*b* and 37*b* which are formed in the upper sides of the supporting plates 36 and 37 and are second guide portions guiding the attachment and detachment of the conveyance guide member 32.

When the jammed sheet recovery is completed in the sheet feeding portion 30 by extracting the conveyance guide member 32, the user holds the handle 32*a* of the conveyance guide member 32 and pushes the conveyance guide member 32 in a direction indicated by an arrow B. At this time, the conveyance guide member 32 is guided to a home position which is a predetermined mounting position of the printer body 1A, while the protrusion portions 32*b*1 to 32*b*4 are moved (slid) along the upper guide grooves 36*b* and 37*b* of the supporting plates 36 and 37. Then, after the conveyance guide member 32 is guided to the home position, the conveyance guide member 32 is fixed at the home position by a lock member (not illustrated) so that the conveyance guide member 32 can guide a sheet being conveyed.

Next, after mounting the conveyance guide member 32, the user holds the handle 31*a* of the sheet feeding cassette 31 and pushes the sheet feeding cassette 31 in the direction indicated by the arrow B. At this time, the sheet feeding cassette 31 is guided to the home position on the rear side of the printer body 1A, while the protrusion portions 31*b*1 to 31*b*4 are moved along the lower guide grooves 36*a* and 37*a* of the supporting plates 36 and 37. Then, after the sheet feeding cassette 31 is guided to the home position in this way, the sheet feeding cassette 31 is fixed at the home position by a lock member (not illustrated).

In this embodiment, when jamming occurs in the sheet feeding portion 30, the user first extracts the sheet feeding cassette 31 and then extracts the conveyance guide member 32, as necessary. When the conveyance guide member 32 is extracted from the printer body 1A by guiding the attachment and detachment of the conveyance guide member 32 by the upper guide grooves 36*b* and 37*b*, a space is secured near the sheet feeding portion. As a result, since the jammed sheet recovery can easily be performed in the sheet feeding portion 30, it is possible to provide the image forming apparatus realizing a satisfactory usability in the jammed sheet recovery.

Figure 4A:
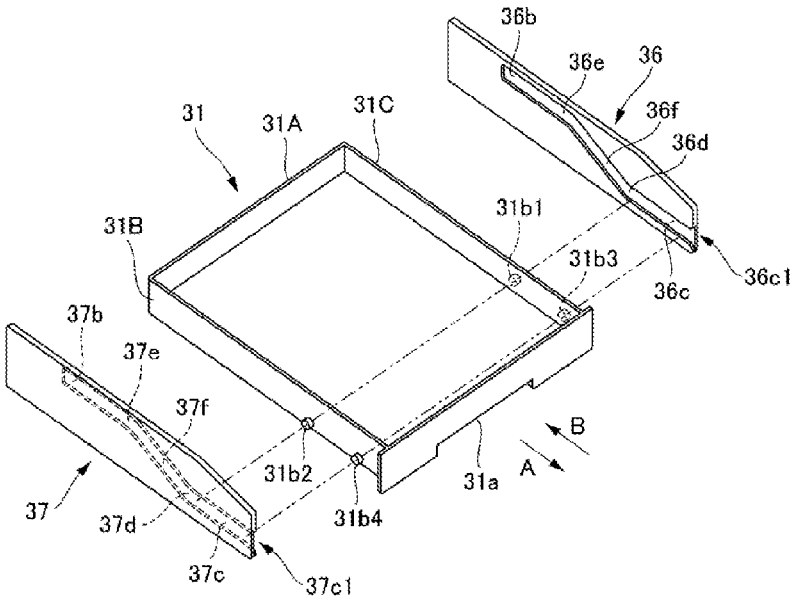
FIGS. 4A and 4B are diagrams illustrating the configuration of a guide portion, a sheet feeding cassette, and a conveyance guide member installed in an image forming apparatus according to a second embodiment of the invention.
Figure 4B:
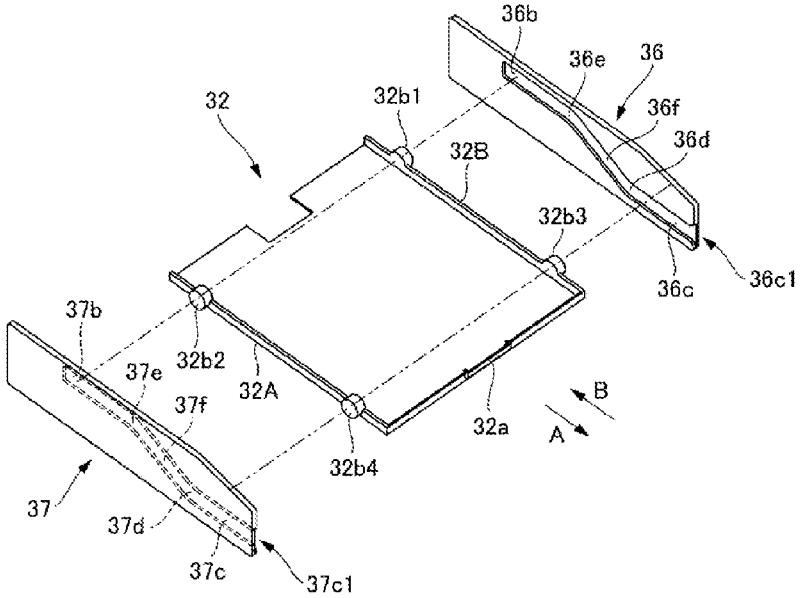

Next, a second embodiment of the present invention will be described. FIGS. 4A and 4B are diagrams illustrating the configuration of a guide portion, a sheet feeding cassette, and a conveyance guide member installed in an image forming apparatus according to the second embodiment of the invention. In FIGS. 4A and 4B, the same reference numerals are given to the same or corresponding constituent portions as those described in FIGS. 2A and 2B.

Figure 5:
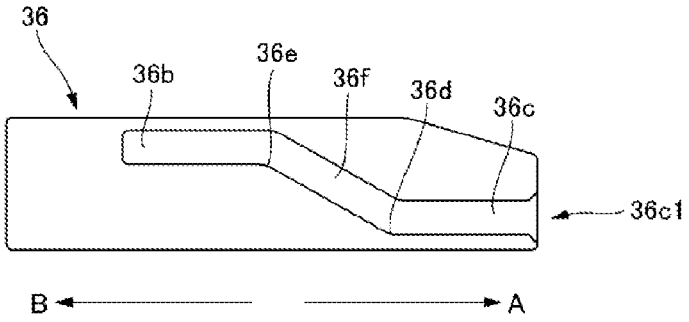
FIG. 5 is a side view illustrating the guide portion.

In this embodiment, as illustrated in FIG. 4A, four protrusion portions 31*b*1 to 31*b*4 of a sheet feeding cassette 31 are formed on the downstream side of an extraction direction of a cassette body 31A indicated by an arrow A. As illustrated in FIG. 5, a lower guide groove 36*c* into which the protrusion portions 31*b*1 and 31*b*3 of the sheet feeding cassette 31 are inserted at the time of mounting the sheet feeding cassette 31 is formed in one supporting plate 36. Further, an opening portion 36*c*1 into which the protrusion portions 31*b*1 and 31*b*3 are inserted is formed on the upstream end of the lower guide groove 36*c* in the mounting direction.

As illustrated in FIGS. 4A and 4B, a lower guide groove 37*c* which extends in the attachment and detachment directions and which the protrusion portions 31*b*2 and 31*b*4 of the sheet feeding cassette 31 are inserted into at the time of mounting the sheet feeding cassette 31 is formed in the lower portion of the other supporting plate 37. Further, an opening portion 37*c*1 into which the protrusion portions 31*b*2 and 31*b*4 are inserted is formed on the upstream end of the lower guide groove 37*c* in the mounting direction. The lower guide groove 37*c* is formed to be symmetric to the lower guide groove 36*c* of the one supporting plate 36.

An upper guide groove 36*b* which extends in the attachment and detachment directions and which the protrusion portion 32*b*1 located on the downstream side of the conveyance guide member 32 in the mounting direction is inserted into at the time of mounting the conveyance guide member 32 is formed in the upper portion of the one supporting plate 36. A communication guide groove 36*f* which causes the upper guide groove 36*b* to communicate with the lower guide groove 36*c* is formed between the upper guide groove 36*b* and the lower guide groove 36*c*.

As illustrated in FIGS. 4A and 4B, an upper guide groove 37*b* which extends in the attachment and detachment directions and which the protrusion portion 32*b*2 located on the downstream side of the conveyance guide member 32 in the mounting direction is inserted into at the time of mounting the conveyance guide member 32 is symmetrically formed in the upper portion of the other supporting plate 37. A communication guide groove 37*f* that causes the upper guide groove 37*b* to communicate with the lower guide groove 37*c* is formed between the upper guide groove 37*b* and the lower guide groove 37*c*.

To mount the conveyance guide member 32 on an image forming apparatus body (hereinafter, referred to as an apparatus body) (not illustrated), the protrusion portions 32*b*1 and 32*b*2 of the conveyance guide member 32 are first inserted into the lower guide grooves 36*c* and 37*c* from the opening portions 36*c*1 and 37*c*1. Thereafter, the protrusion portions 32*b*1 and 32*b*2 pass through the lower guide grooves 36*c* and 37*c* and the communication guide grooves 36*f* and 37*f*, and then are inserted into the upper guide grooves 36*b* and 37*b*.

Figure 6:
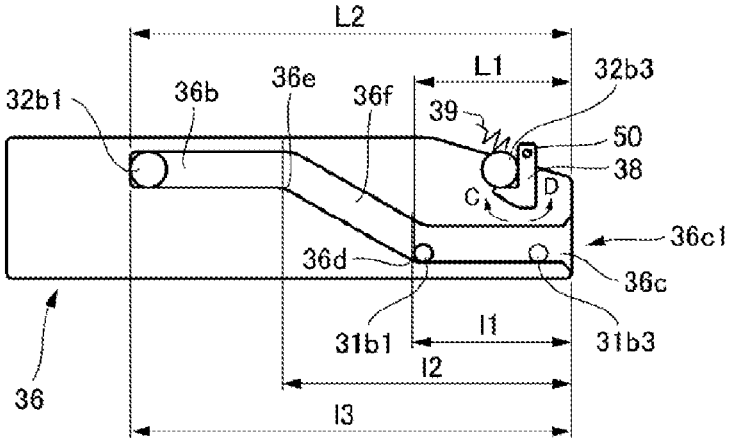
FIG. 6 is a diagram illustrating a state in which the sheet feeding cassette and the conveyance guide member are mounted on the guide portion.

In this embodiment, after the protrusion portions 32*b*1 and 32*b*2 are inserted into the upper guide grooves 36*b* and 37*b*, the protrusion portion 32*b*3 located on the upstream side of the conveyance guide member 32 in the mounting direction is supported to be detachably locked by a lock member 38 illustrated in FIG. 6. Further, the protrusion portion 32*b*4 which does not engage with the upper guide groove 37*b* is supported by a lock member (not illustrated). Thus, since the protrusion portions 32*b*3 and 32*b*4 which do not engage with the upper guide groove 36*b* are supported by the lock member 38 which is an engagement portion, the conveyance guide member 32 is horizontally supported. In FIG. 6, an upstream inflection portion 36*d* of the communication guide groove 36*f* of the one supporting plate 36 is illustrated, and a downstream inflection portion 36*e* of the communication guide groove 36*f* is also illustrated. The other supporting plate 37 has the same configuration.

Figure 7A:
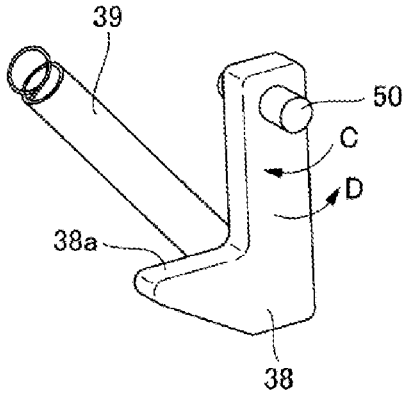
FIGS. 7A and 7B are diagrams illustrating the configuration of a lock member supporting the conveyance guide member allowing the member to be engaged and disengaged.
Figure 7B:
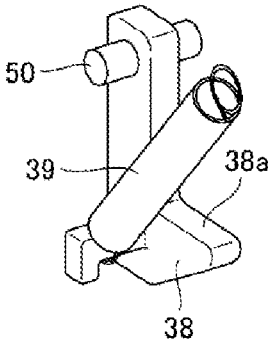

As illustrated in FIGS. 7A and 7B, the lock member 38 is rotatably mounted on a shaft 50 formed in the supporting plate 36 or 37 or the apparatus body and is urged in a direction C by a lock spring 39. Further, the lock member 38 includes a lock portion 38*a* which locks the protrusion portion 32*b*3 of the conveyance guide member 32 when the conveyance guide member 32 is mounted.

To extract the conveyance guide member 32, the handle 32*a* is drawn toward the lower side of the apparatus body. Thus, the lock member 38 receives a downward force from the protrusion portion 32*b*3 of the conveyance guide member 32, is rotated about the shaft 50 in a D direction against the lock spring 39, and releases the locking of the protrusion portion 32*b*3 of the conveyance guide member 32 by the lock portion 38*a*. When the locking of the lock member 38 is released, the conveyance guide member 32 can be extracted. In this embodiment, as illustrated in FIG. 4B, the lengths of the protrusion portions 32*b*3 and 32*b*4 of the conveyance guide member 32 in a width direction are shorter than the protrusion portions 32*b*1 and 32*b*2 so that the conveyance guide member 32 does not come into contact with the supporting plates 36 and 37 when the conveyance guide member 32 is mounted and detached.

In the image forming apparatus with the above-described configuration, the user holds the handle 31*a* of the sheet feeding cassette 31 illustrated in FIG. 4A and extracts the sheet feeding cassette 31 in the direction indicated by the arrow A, when extracting the sheet feeding cassette 31 to the front side of the apparatus body. Thus, the sheet feeding cassette 31 is guided to the front side of the apparatus body, while the protrusion portions 31*b*1 to 31*b*4 are moved along the lower guide grooves 36*c* and 37*c*.

Further, when the conveyance guide member 32 is extracted, the handle 32*a* is pressed downward to release the locking (supporting) of the conveyance guide member 32 by the lock member 38. Thereafter, the conveyance guide member 32 is extracted in the direction indicated by the arrow A illustrated in FIG. 4B. Thus, the conveyance guide member 32 is guided to the front side of the apparatus body, while the protrusion portions 32*b*1 and 32*b*2 are moved along the communication guide grooves 36*f* and 37*f* and the lower guide grooves 36*c* and 37*c*.

On the other hand, when the recovery of the jammed sheet in the sheet feeding portion 30 ends by extracting the conveyance guide member 32, the conveyance guide member 32 is first mounted on the apparatus body in this embodiment. This is because when the sheet feeding cassette 31 is first mounted, the sheet feeding cassette 31 is obstructed and the conveyance guide member 32 may not be mounted.

When mounting the conveyance guide member 32, the user holds the handle 32*a* of the conveyance guide member 32 and pushes the conveyance guide member 32 in the direction indicated by the arrow B. Thus, the conveyance guide member 32 ascends while the protrusion portions 32*b*1 and 31*b*2 are moved along the opening portions 36*c*1 and 37*c*1, the lower guide grooves 36*c* and 37*c*, and the communication guide grooves 36*f* and 37*f*, and consequently becomes parallel to the lower guide grooves 36*c* and 37*c* in the boundary of the downstream inflection portions 36*e* and 37*e*.

As illustrated in FIG. 6, it is assumed that l1 is a distance between the upstream end surface (hereinafter, referred to as an upstream end surface) of the lower guide groove 36*c* in the mounting direction and the upstream inflection portion 36*d*, and l2 is a distance between the upstream end surface of the lower guide groove 36*c* and the downstream inflection portion 36*e*. It is also assumed that l3 is a distance between the upstream end surface of the lower guide groove 36*c* and the downstream end surface (hereinafter, referred to as a downstream end surface) of the upper guide groove 36*b* in the mounting direction. It is assumed that L1 is a distance between the upstream end surface of the lower guide groove 36*c* and the downstream end of the protrusion portion 31*b*1 of the sheet feeding cassette 31 in the mounting direction on the downstream side in the mounting direction. It is also assumed that L2 is a distance between the upstream end surface of the lower guide groove 36*c* and the downstream end of the protrusion portion 32*b*1 in the mounting direction on the downstream side of the conveyance guide member 32 in the mounting direction. In this embodiment, l1 to l3, L1, and L2 are set so that a relation of "l3≥L2>l2>l1≥L1" is satisfied among l1 to l3, L1, and L2.

Therefore, when the conveyance guide member 32 is pushed, the protrusion portions 32*b*1 and 32*b*2 respectively pass through the upstream inflection portions 36*d* and 37*d* and the downstream inflection portions 36*e* and 37*e* and are inserted up to the downstream surfaces of the upper guide grooves 36*b* and 37*b* based on the relation of "l3≥L2>12>11". Thereafter, by locking the protrusion 32*b*3 on the upstream side in the mounting direction by the lock member 38, the conveyance guide member 32 is fixed at the home position.

Thereafter, when the sheet feeding cassette 31 is pushed into the apparatus body, the protrusion portions 31*b*1 to 31*b*4 pass through the lower guide grooves 36*c* and 37*c*, respectively. At this time, before the protrusion portions 31*b*1 and 31*b*2 reach the upstream inflection portions 36*d* and 37*d*, the protrusion portions 31*b*1 and 31*b*2 of the sheet feeding cassette 31 reach the home position and are fixed by the lock member (not illustrated) based on a relation of "l1≥L1". Further, since the conveyance guide member 32 is already supported by the lock member 38 and the upper guide grooves 36*b* and 37*b* located above the lower guide grooves 36*c* and 37*c*, the mounting of the sheet feeding cassette 31 is not obstructed by the conveyance guide member 32.

As described above, in this embodiment, to mount the sheet feeding cassette 31 and the conveyance guide member 32 on the apparatus body, the conveyance guide member 32 is first mounted and the sheet feeding cassette 31 is then mounted. Further, when the conveyance guide member 32 is mounted, the protrusion portions 32*b*1 and 31*b*2 are pushed into the opening portions 36*c*1 and 37*c*1 of the lower guide grooves 36*c*and 37*c*. That is, the opening portions into which the protrusion portions 32*b*1 and 31*b*2 are pushed at the time of mounting the conveyance guide member 32 are shared with the opening portions 36*c*1 and 37*c*1 into which the protrusion portions 31*b*1 to 31*b*4 of the sheet feeding cassette 31 are pushed at the time of mounting the sheet feeding cassette 31.

By sharing the opening portions 36*c*1 and 37*c*1, in other words, by commonly using the opening portions 36*c*1 and 37*c*1, the sheet feeding cassette 31 and the conveyance guide member 32 can be reliably mounted on the apparatus body unless the mounting order is incorrect.

In this embodiment, as described above, the opening portions 36*c*1 and 37*c*1 of the upper guide grooves 36*b* and 37*b* and the lower guide grooves 36*c* and 37*c* are commonly used by continuously forming the upper guide grooves 36*b* and 37*b* on the downstream side of the lower guide grooves 36*c* and 37*c* in the mounting direction. Thus, the sheet feeding cassette 31 and the conveyance guide member 32 can be mounted from the same opening portions 36*c*1 and 37*c*1. Further, by commonly using the opening portions 36*c*1 and 37*c*1, the opening portions 36*c*1 and 37*c*1 are not mistaken. Accordingly, the sheet feeding cassette 31 and the conveyance guide member 32 can reliably be mounted on the apparatus body and the apparatus body can be more compact.

Figure 8A:
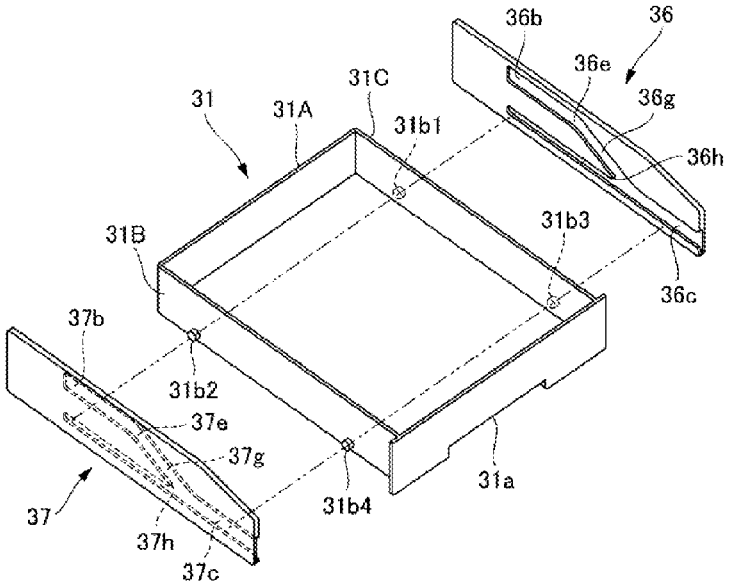
FIGS. 8A and 8B are diagrams illustrating the configuration of a guide portion, a sheet feeding cassette, and a conveyance guide member installed in an image forming apparatus according to a third embodiment of the invention.
Figure 8B:
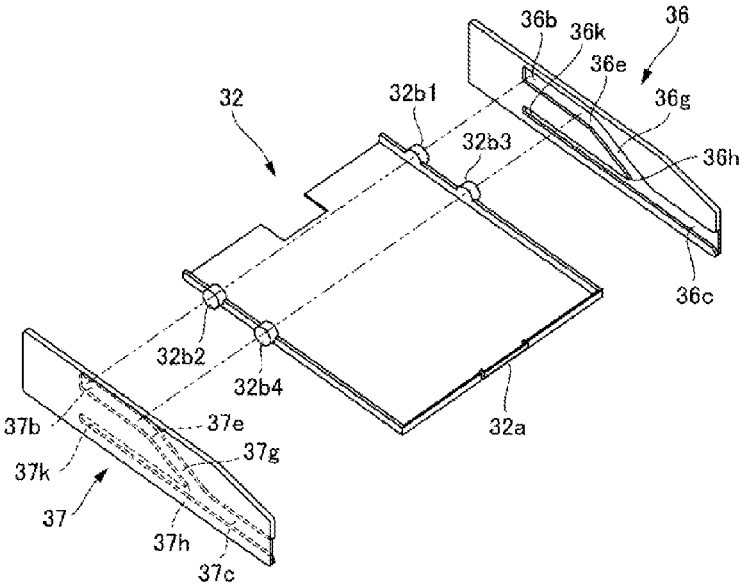

Next, a third embodiment of the present invention will be described. FIGS. 8A and 8B are diagrams illustrating the configuration of a guide portion, a sheet feeding cassette, and a conveyance guide member installed in an image forming apparatus according to the this embodiment of the invention. In FIGS. 8A and 8B, the same reference numerals are given to the same or corresponding constituent portions as those described in FIGS. 4A and 4B.

In this embodiment, as illustrated in FIG. 8B, four protrusion portions 32*b*1 to 32*b*4 of the conveyance guide member 32 are installed on the downstream side of the conveyance guide member 32 in the mounting direction. Further, lower guide grooves 36*c* and 37*c* into which protrusion portions 31*b*1 to 31*b*4 of the sheet feeding cassette 31 are inserted at the time of mounting the sheet feeding cassette 31 are symmetrically formed in two supporting plates 36 and 37.

Upper guide grooves 36*b* and 37*b* which extend in the attachment and detachment directions and which the protrusion portions 32*b*1 to 32*b*4 of the conveyance guide member 32 are inserted into at the time of mounting the conveyance guide member 32 are symmetrically formed in the upper portions of the two supporting plates 36 and 37. The upper guide grooves 36*b* and 37*b* are branched from the lower guide grooves 36*c* and 37*c*, respectively. The upper guide grooves 36*b*and 37*b* and the lower guide grooves 36*c* and 37*c* are connected by communication guide grooves 36*g* and 37*g*, respectively.

When the conveyance guide member 32 is mounted on the apparatus body, the protrusion portions 32*b*1 to 32*b*4 of the conveyance guide member 32 are caused to pass through the lower guide grooves 36*c* and 37*c* and the communication guide grooves 36*g* and 37*g*, and then are inserted into the upper guide grooves 36*b* and 37*b*. Thus, the conveyance guide member 32 is horizontally supported by the four protrusion portions 32*b*1 to 32*b*4 inserted into the upper guide grooves 36*b* and 37*b* without using the lock member 38 described in the second embodiment.

Figure 9:
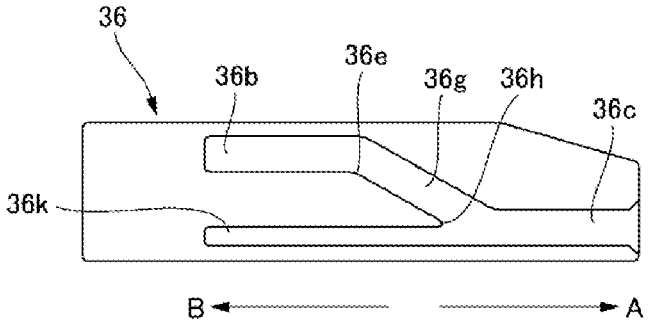
FIG. 9 is a side view illustrating the guide portion.
Figure 10:
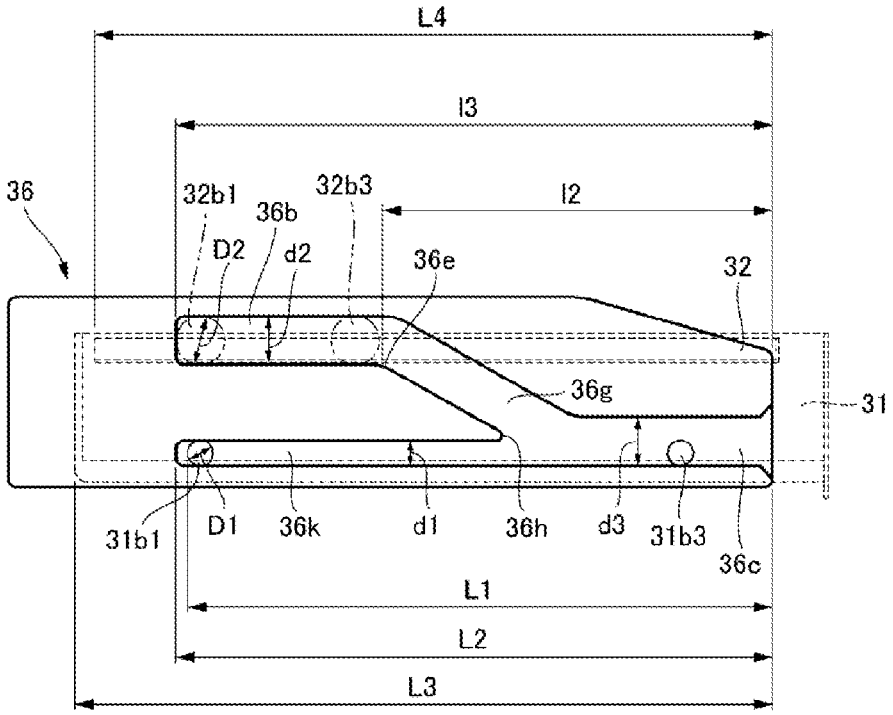
FIG. 10 is a diagram illustrating a state in which the sheet feeding cassette and the conveyance guide member are mounted on the guide portion.

FIG. 9 is a diagram illustrating the configuration of one supporting plate 36. In FIG. 9, a downstream inflection portion 36*e* of the communication guide groove 36*g* and an upstream inflection portion 36*h* of the communication guide groove 36*g* are illustrated. As illustrated in FIG. 10, it is assumed that l2 is a distance between the upstream end surface of the lower guide groove 36*c* and the downstream inflection portion 36*e*. It is also assumed that L1 is a distance between the upstream end surface of the lower guide groove 36*c* and the downstream portion of the protrusion portion 31*b*1 in the mounting direction on the downstream side of the sheet feeding cassette 31 in the mounting direction. It is also assumed that l3 is a distance between the upstream end surface of the lower guide groove 36*c* and the downstream portion of the protrusion portion 32*b*1 of the conveyance guide member 32, and L2 is a distance between the upstream end surface of the lower guide groove 36*c* and the downstream end surface of the lower guide groove 36*c*. It is also assumed that L3 is a distance between the upstream end surface of the lower guide groove 36*c* and an insertion surface of the sheet feeding cassette 31, and L4 is a distance between the upstream end surface of the lower guide groove 36*c* and the insertion surface of the conveyance guide member 32. In this embodiment, l3, l2, and L2 are set such that a relation of "l3>L2>l2" is satisfied among l3, l2, and L2. By setting the distances to have this relation, the downstream portion of the lower guide groove 36*c* can be formed on the further downstream side than the upstream inflection portion 36*d* described in FIG. 6.

Here, when the protrusion portions 31*b*1 to 31*b*4 and 32*b*1 to 32*b*4 are inserted into the lower guide groove 36*c*, each guided portion is guided to the lower guide groove 36*c* at the timing at which the sheet feeding cassette 31 is inserted into the apparatus body as long as a relation of "L3−L1=0" is satisfied. Accordingly, the user can insert the sheet feeding cassette 31 into the apparatus body with more ease, as the value of "L3−L1" is smaller. Further, the user can likewise insert the conveyance guide member 32 with more ease, as the value of "L4−L2" is smaller.

It is also assumed that D1 is a diameter of the protrusion portion 31*b*1 of the sheet feeding cassette 31, D2 is a diameter of the protrusion portion 32*b*1 of the conveyance guide member 32, d1 is a vertical width between the downstream side portions 36*k* and 37*k* of the lower guide grooves 36*c* and 37*c*, and d2 is a vertical width between the upper guide grooves 36*b* and 37*b*. It is also assumed that d3 is a vertical width between the lower guide grooves 36*c* and 37*c*. Then, in this embodiment, a relation of "d3≥d2≥D2>d1≥D1" is satisfied among D1, D2, d1, d2, and d3.

When the conveyance guide member 32 is pushed into the apparatus body, the protrusion portions 32*b*1 to 32*b*4 of the conveyance guide member 32 pass through the lower guide grooves 36*c* and 37*c*, respectively. At this time, based on the relation of "d3≥d2≥D2>d1", the conveyance guide member 32 is guided from the upstream inflection portions 36*h* and 37*h* to the upper guide grooves 36*b* and 37*b* formed in the upper sides of the downstream-side portions 36*k* and 37*k* of the lower guide grooves 36*c* and 37*c*.

In regard to the protrusion portions 32*b*3 on the upstream side of the conveyance guide member 32 in the mounting direction, the inside of the upper guide groove 36*b* may be set as the home position or the position which is fixed by the lock member 38 described in the second embodiment may be set as the home position. When a relation of "D2/2≥d1" is satisfied, that is, a center between the protrusion portions 32*b*1 and 32*b*2 of the conveyance guide member 32 is located above the upper surfaces of the upstream inflection portions 36*h* and 37*h* to the upper side of the apparatus body, the conveyance guide member 32 is more easily inserted.

When the sheet feeding cassette 31 is pushed into the apparatus body, based on the relation of "d1≥D1", the protrusion portions 31*b*1 and 31*b*2 on the downstream side of the sheet feeding cassette 31 in the mounting direction are guided to the downstream-side portions 36*k* and 37*k* of the lower guide grooves 36*c* and 37*c*. That is, by providing the downstream-side portions 36*k* and 37*k* in the lower guide grooves 36*c* and 37*c*, the protrusion portions 31*b*1 and 31*b*2 of the sheet feeding cassette 31 can be formed on the downstream side in the mounting direction. Accordingly, the sheet feeding cassette 31 can easily be inserted into the apparatus body.

In this embodiment, by branching the upper guide grooves 36*b* and 37*b* from the lower guide grooves 36*c* and 37*c*, the opening portions 36*c*1 and 37*c*1 can be commonly used. Thus, since the opening portions 36*c*1 and 37*c*1 are not mistaken, the sheet feeding cassette 31 and the conveyance guide member 32 can reliably be mounted on the apparatus body and the apparatus body can be also more compact. Further, by branching the upper guide grooves 36*b* and 37*b* from the lower guide grooves 36*c* and 37*c*, the protrusion portions 31*b*1 and 31*b*2 of the sheet feeding cassette 31 can be formed on the downstream side in the mounting direction. Thus, the sheet feeding cassette 31 can easily be inserted into the apparatus body.

In the above-described embodiments, the configuration in which the user sets a manually-fed sheet in the tray of the manual sheet feeding portion one by one, the configuration of the manual feeding portion is not limited thereto. For example, a separating mechanism such as a separation pad may be abutted to the manual sheet feeding roller, the user may set a plurality of sheets in the manual tray, and the sheets may continuously be fed by the manual sheet feeding roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-045801, filed Mar. 1, 2012, which is hereby incorporated by reference herein in its entirety.

What is claimed is:

1. An image forming apparatus comprising:

an image forming portion that forms an image on a sheet;

a sheet accommodation portion that is detachably mounted on an apparatus body and accommodates sheets to be formed with an image by the image forming portion;

a conveyance guide member that is detachably mounted on the apparatus body above the sheet accommodation portion mounted on the apparatus body and that forms a sheet conveyance path which guides a sheet;

supporting portions that are provided in the apparatus body to face each other and that laterally support the sheet accommodation portion and the conveyance guide member, the supporting portions including first guide portions which guide attachment and detachment of the sheet accommodation portion into and from the apparatus body and second guide portions which guide attachment and detachment of the conveyance guide member into and from the apparatus body;

accommodation guided portions which are provided on both sides of the sheet accommodation portion in an attachment and detachment direction of the sheet accommodation portion and are slid along the first guide portions; and conveyance guided portions which are provided on both sides of the conveyance guide member in the attachment and detachment direction of the conveyance guide member and slid along the second guide portions, wherein the second guide portions are branched from the first guide portions, and common opening portions which the accommodation guided portions and the conveyance guided portions are inserted into and extracted from are formed at upstream-side ends of the first guide portions.

2. The image forming apparatus according to claim 1, wherein the conveyance guided portions are slid along the first guide portions and the second guide portions so that the conveyance guide member is mounted, and after the conveyance guide member is mounted, the accommodation guided portions are slid along the first guide portions so that the sheet accommodation portion is mounted.

3. An image forming apparatus comprising:

a sheet stacking member on which sheets are stacked, the sheet stacking member configured to be drawn from and attached to an apparatus body, a conveyance guide member having sheet conveyance paths through which a sheet is conveyed, the conveyance guide member configured to be drawn from and attached to the apparatus body, a common guide portion which is disposed on the apparatus body and which guides the conveyance guide member and the sheet stacking member during the attachment to and the drawing from the apparatus body, a first guide portion which is disposed on the apparatus body downstream of the common guide portion in an attachment direction of the sheet stacking member to the apparatus body, the first guide portion guiding the sheet stacking member during the attachment to and the drawing from the apparatus body, and a second guide portion which is disposed on the apparatus body downstream of the common guide portion in an attachment direction of the conveyance guide member to the apparatus body, the second guide portion guiding the conveyance guide member during the attachment to and the drawing from the apparatus body, wherein the common guide portion branches into the first guide portion and the second guide portion, and wherein the first guide portion is configured so as not to guide the conveyance guide member.

4. The image forming apparatus according to claim 3, further comprising:

a protrusion portion on the conveyance guide member and an engagement portion mounted elsewhere on the apparatus, wherein the protrusion portion is configured so as not to engage with the second guide portion and to detachable lock with the engagement portion when the conveyance guide member is mounted.

5. The image forming apparatus according to claim 3, further comprising:

a first engaging portion which is disposed on the sheet stacking member and engages with the common guide portion and the first guide portion, a second engaging portion which is disposed on the conveyance guide member and engages with the common guide portion and the second guide portion, wherein a length of the first guide portion in a height direction of the apparatus body is shorter than a length of the second guide portion in a height direction of the apparatus body, and a length of the second engaging portion in a height direction of the apparatus body is longer than a length of the first guide portion in a height direction of the apparatus body.

6. The image forming apparatus according to claim 3, wherein the common guide portion is a pair of grooves disposed symmetrically on one side wall and the other side wall of the apparatus body, the first guide portion is a pair of grooves disposed symmetrically on one side wall and the other side wall of the apparatus body, and the second guide portion is a pair of grooves disposed symmetrically on one side wall and the other side wall of the apparatus body.

7. The image forming apparatus according to claim 5, wherein the first engaging portion consists of projections at both sides of the stacking member which are projecting in a direction perpendicular to a direction in which the stacking member is attached to the apparatus body, and the second engaging portion consists of projections at both sides of the conveyance guide member which are projecting in a direction perpendicular to a direction in which the conveyance guide member is attached to the apparatus body.

8. The image forming apparatus according to claim 3, wherein the conveyance guide member comprises a sheet conveyance path on which a sheet passes in a status that the sheet stacking member and the conveyance guide member is attached on the apparatus body.

9. The image forming apparatus according to claim 3, wherein at an upstream end of the common guide portion in an attaching direction of the conveyance guide member, a common opening portion is formed, into which a first engaging portion on the sheet stacking member and a second engaging portion on the conveyance guide member insert and draw.

10. The image forming apparatus according to claim 3, wherein the conveyance guide member is slid along the common guide portion and the second guide portion so that the conveyance guide member is mounted, and after the conveyance guide member is mounted, the stacking member is slid along the common guide portion and the first guide portion so that the sheet accommodation portion is mounted.

11. The image forming apparatus according to claim 3, further comprising:

a manual sheet feeding portion that feeds a sheet manually set thereon, wherein the stacking member is a sheet feed cassette to accommodate sheets, and the conveyance guide member is a guide which guides the sheet fed from the manual sheet feeding portion.

12. An image forming apparatus comprising:

a sheet stacking member on which sheets are stacked, the sheet stacking member configured to be drawn from and attached to an apparatus body, a conveyance guide member having sheet conveyance paths through which a sheet is conveyed, the conveyance guide member configured to be drawn from and attached to the apparatus body, a common guide portion which is disposed on the apparatus body and which guides the conveyance guide member and the sheet stacking member during the attachment to and the drawing from the apparatus body, a first guide portion which is disposed on the apparatus body downstream of the common guide portion in an attachment direction of the sheet stacking member to the apparatus body, the first guide portion guiding the sheet stacking member during the attachment to and the drawing from the apparatus body, a second guide portion which is disposed on the apparatus body downstream of the common guide portion in an attachment direction of the conveyance guide member to the apparatus body, the second guide portion guiding the conveyance guide member during the attachment to and the drawing from the apparatus body, a first engaging portion which is disposed on the sheet stacking member and engages with the common guide portion and the first guide portion, and a second engaging portion which is disposed on the conveyance guide member and engages with the common guide portion and the second guide portion, wherein the common guide portion branches into the first guide portion and the second guide portion, wherein a length of the first guide portion in a height direction of the apparatus body is shorter than a length of the second guide portion in a height direction of the apparatus body, and a length of the second engaging portion in a height direction of the apparatus body is longer than a length of the first guide portion in a height direction of the apparatus body.

13. The image forming apparatus according to claim 12, wherein at an upstream end of the common guide portion in an attaching direction of the conveyance guide member, a common opening portion is formed, into which engaging portions of the first engaging portion and the second engaging portion insert and draw.

* * * * *